US009879444B2

(12) United States Patent
Gibbs et al.

(10) Patent No.: US 9,879,444 B2
(45) Date of Patent: Jan. 30, 2018

(54) POST SUPPORT DEVICE

(71) Applicant: STEADYPOST LIMITED, Hampshire (GB)

(72) Inventors: John Robert Gibbs, Hampshire (GB); Andrew John Gibbs, Sussex (GB)

(73) Assignee: STEADYPOST LIMITED, Hampshire (GB)

( * ) Notice: Subject to any disclaimer, the term of this patent is extended or adjusted under 35 U.S.C. 154(b) by 0 days.

(21) Appl. No.: 14/897,195

(22) PCT Filed: Jun. 12, 2014

(86) PCT No.: PCT/GB2014/000225
§ 371 (c)(1),
(2) Date: Dec. 9, 2015

(87) PCT Pub. No.: WO2014/199112
PCT Pub. Date: Dec. 18, 2014

(65) Prior Publication Data

US 2016/0138297 A1 May 19, 2016

(30) Foreign Application Priority Data

Jun. 14, 2013 (GB) ..... 1310621.6

(51) Int. Cl.
*E04H 12/22* (2006.01)
*E04H 17/22* (2006.01)

(52) U.S. Cl.
CPC ..... *E04H 17/22* (2013.01); *E04H 12/22* (2013.01); *E04H 12/2215* (2013.01)

(58) Field of Classification Search
CPC ..... E04H 12/20; E04H 12/22; E04H 12/2215; E04H 12/223; E04H 17/20; E04H 17/22
(Continued)

(56) References Cited

U.S. PATENT DOCUMENTS 642,470 A * 1/1900 Mathews ..... E04H 12/2215 52/153
677,090 A 6/1901 Lanz
(Continued)

FOREIGN PATENT DOCUMENTS

DE 3507269 A1 5/1986
FR 2839099 A1 10/2013
(Continued)

OTHER PUBLICATIONS

UK Intellectual Property Office, Search Report Under Section 17, GB 1115427.5, dated Dec. 9, 2011.
(Continued)

*Primary Examiner* — Jonathan Liu
*Assistant Examiner* — Guang H Guan
(74) *Attorney, Agent, or Firm* — Reichel Stohry LLP; Natalie J. Dean; Mark C. Reichel

(57) ABSTRACT

The present invention relates to a post support device (1) for a post (10) adapted to be inserted substantially vertically in the ground. The post (10) has a top end (10A) and a bottom end (10B). The support device comprises a support member (2,3) adapted to engage the post below ground level at a point remote from the post bottom end, and at least two pairs of fins (2A,2B; 3A,3B), each pair of which extend from and form a triangulated structure with the support member and/or post. In use, with the post with the support device attached thereto is inserted substantially vertically in the ground, and the fins provide lateral resistance to prevent the post from displacing the soil and tilting towards the horizontal.

7 Claims, 8 Drawing Sheets

(58) Field of Classification Search
USPC .... 52/153, 154, 155, 156, 165, 166; 248/76, 248/85, 87, 156, 507, 508, 530, 545; 405/244; 256/65.14; 40/607.05, 607.06, 40/607.08, 607.11
See application file for complete search history.

(56) References Cited

U.S. PATENT DOCUMENTS 887,217 A * 5/1908 Oliphant ..... 52/295
1,578,947 A * 3/1926 Alber ..... E04B 5/12 52/370
2,350,433 A * 6/1944 Vernon ..... G09F 7/18 248/300
2,633,947 A * 4/1953 Schiff ..... E04H 12/223 405/244
3,012,644 A * 12/1961 Bush ..... E02D 5/803 405/244
3,100,033 A * 8/1963 Hanson ..... E04G 11/22 403/391
3,138,886 A * 6/1964 Cobb ..... G09F 15/0018 40/604
3,327,415 A * 6/1967 Pearson ..... G09F 7/18 40/666
3,727,357 A * 4/1973 Stillman, Jr. ..... E04H 12/2215 248/156
3,750,360 A * 8/1973 Kingston ..... E04B 1/41 52/295
3,896,596 A * 7/1975 Berger ..... E04H 12/2215 256/47
4,021,977 A * 5/1977 Deike ..... E01F 9/685 52/298
4,283,162 A * 8/1981 Parker, Jr. ..... E02D 5/54 405/244
4,320,608 A * 3/1982 Deike ..... E04H 12/2215 248/316.3
4,516,365 A * 5/1985 Chapman ..... E04H 12/2292 52/170
4,553,358 A * 11/1985 Deike ..... E02D 5/80 248/519
4,574,507 A * 3/1986 Elliott ..... G09F 7/18 40/607.11
5,133,164 A * 7/1992 Legler ..... E04H 12/2261 52/165
5,560,131 A * 10/1996 Gibson ..... G09F 7/20 40/607.12
5,730,555 A 3/1998 Stoner
6,039,298 A * 3/2000 Stier ..... A47G 29/1216 248/156
6,764,251 B1 * 7/2004 Schnur ..... B63B 21/38 405/224
7,594,782 B2 * 9/2009 Smith ..... E04H 12/2215 405/244
8,074,422 B2 * 12/2011 O'Neil ..... F16L 3/11 248/300
8,398,036 B2 * 3/2013 Svedberg ..... E04G 21/3223 248/154
8,458,966 B2 * 6/2013 O'Toole ..... E04H 17/22 248/219.4
8,584,413 B1 * 11/2013 Keller, Sr. ..... E02D 27/32 52/297
2016/0138297 A1 * 5/2016 Gibbs ..... E04H 12/2215 248/530

FOREIGN PATENT DOCUMENTS

GB 21308048 A 10/1984
GB 2162561 A 2/1986
JP 51-160430 U 12/1976
WO WO 96/18788 A1 6/1996

OTHER PUBLICATIONS

UK Intellectual Property Office, Search Report Under Section 17, GB 1310621.6, dated Dec. 2, 2013.
European Patent Office, International Search Report, PCT/GB2014/000225, dated Nov. 20, 2014.

* cited by examiner

POST SUPPORT DEVICE

PRIORITY

The present application is related to, and claims the priority benefit of, and is a 35 U.S.C. 371 national stage application of, International Patent Application Serial No. PCT/GB2014/000225, filed Jun. 12, 2014, which is related to, and claims the priority benefit of, Great Britain Patent Application Serial No. 1310621.6, filed Jun. 14, 2013. The contents of each of these applications are hereby incorporated by reference in their entirety into this disclosure.

TECHNICAL FIELD

The present invention relates to a post support device.

BACKGROUND ART

When erecting a fence, it is normal to erect a line of posts vertically in the ground and connect each post by fence panels, wooden rails, or wire such as barbed wire. When using fence posts it is especially essential that the posts are spaced to the exact width of fence panels and vertical.

One method of erecting posts is to dig a hole in the ground, temporarily hold a post in the hole in the vertical position and the correct distance from an adjacent post, and then pour concrete into the hole. A problem with this is that if the post does not stay vertical whilst the concrete is setting, or the post is not in the correct position, it is not possible to adjust the post position once the concrete has set. Also digging of a hole and mixing up the concrete is time consuming. Also at a later date it is hard to remove the concrete.

Another method of erecting posts is to use a "Metpost" or similar device which is a metal spike with a square section box at one end. The metal spike is hammered into the ground leaving the box just above ground, and a post is inserted and secured into the box. It is very difficult to hammer the spike into the ground so it is exactly vertical and in the correct position as it cannot be done with the post in the box, and stones or roots easily deflect the spike. Also it is difficult to create a rigid connection between the post and the box. It is also difficult to correct the position of the spike.

BRIEF SUMMARY

The invention seeks to provide a post support device for erecting fences and which has other uses.

According to the present invention there is provided a post support device for a post adapted to be inserted substantially vertical in the ground, said post having a top end and a bottom end, said support device comprising:

a) a support member adapted to engage the post below ground level at a point remote from the post bottom end, and b) at least two pairs of fins each pair of which extend from and form a triangulated structure with the support member and/or post, in use, with the post with the support device inserted substantially vertical in the ground, said fins providing lateral resistance against the material in the ground to prevent the post from displacing the soil and tilting towards the horizontal.

The post support device of the invention has numerous advantages over other support mechanisms for posts. It is removable and re-useable. It requires minimal digging of a hole in the ground. The position of the support device in the ground can easily be changed both during erection of fences and afterwards. It can be used for temporary posts or other posts. In use the soil around and between the fins prevents buckling of any fin that is subject to compression forces.

MODES FOR CARRYING OUT THE INVENTION

In one embodiment the post is a fence post.

Preferably the support member includes at least one pair of opposing plates with securement means to secure them either side of the post, and said fins extend from edges of the plates.

In one embodiment the support member includes a pair of opposing plates to be secured to either side of the post, and fins extend from and are integrally formed with opposing edges of each of the plates, and ends of fins from one plate are joined to ends of fins of the other plate and joined fins form a triangulated structure with the plates secured to the post.

In another embodiment the support member includes two pairs of opposing plates to be secured around the post, and fins extend from and are integrally formed with opposing edges of each of the plates, and ends of fins from one plate are joined to ends of fins of another adjacent plate and joined fins form a triangulated structure with two adjacent plates secured to the post.

The fins may be joined by a fastener such as a clip, rivet or screw, or fold in one fin which receives an edge of another fin. Preferably the join between fins provides good shear strength.

The support member and fins may be formed from two or more components which nest one within the other for storage, transport and packaging purposes. The components may be identical.

In another embodiment the support member is in the form of a frame with an aperture therethrough to receive the post, and said fins extend from the frame. The post may include a cylindrical recess to receive a cylindrical post, such as a washing line post.

In another embodiment, the support member includes a first pair of opposing plates to be secured to either side of the post, and a first pair of fins extend from and each is integrally formed with one edge of each of the first pair of plates, and the end of a fin from one plate of said first pair of plates is integrally formed with the end of a fin from the other plate of said first pair of plates, and wherein the support member includes a second pair of opposing plates to be secured to either side of the post, and a second pair of fins extend from and each is integrally formed with one edge of each of the second pair of plates, and the end of a fin from one plate of said second pair of plates is integrally formed with the end of a fin from the other plate of said second pair of plates, integrally formed fins from the first or second pair of plates form a triangulated structure with the pairs of plates secured to the post. Preferably in use, said first and second pairs of plates can be secured to either side of the post with the first and second pairs of plates overlapping.

BRIEF DESCRIPTION OF DRAWINGS

Embodiments of post support devices will now be described with reference to the accompanying drawings in which.

DETAILED DESCRIPTION

Figure 1:
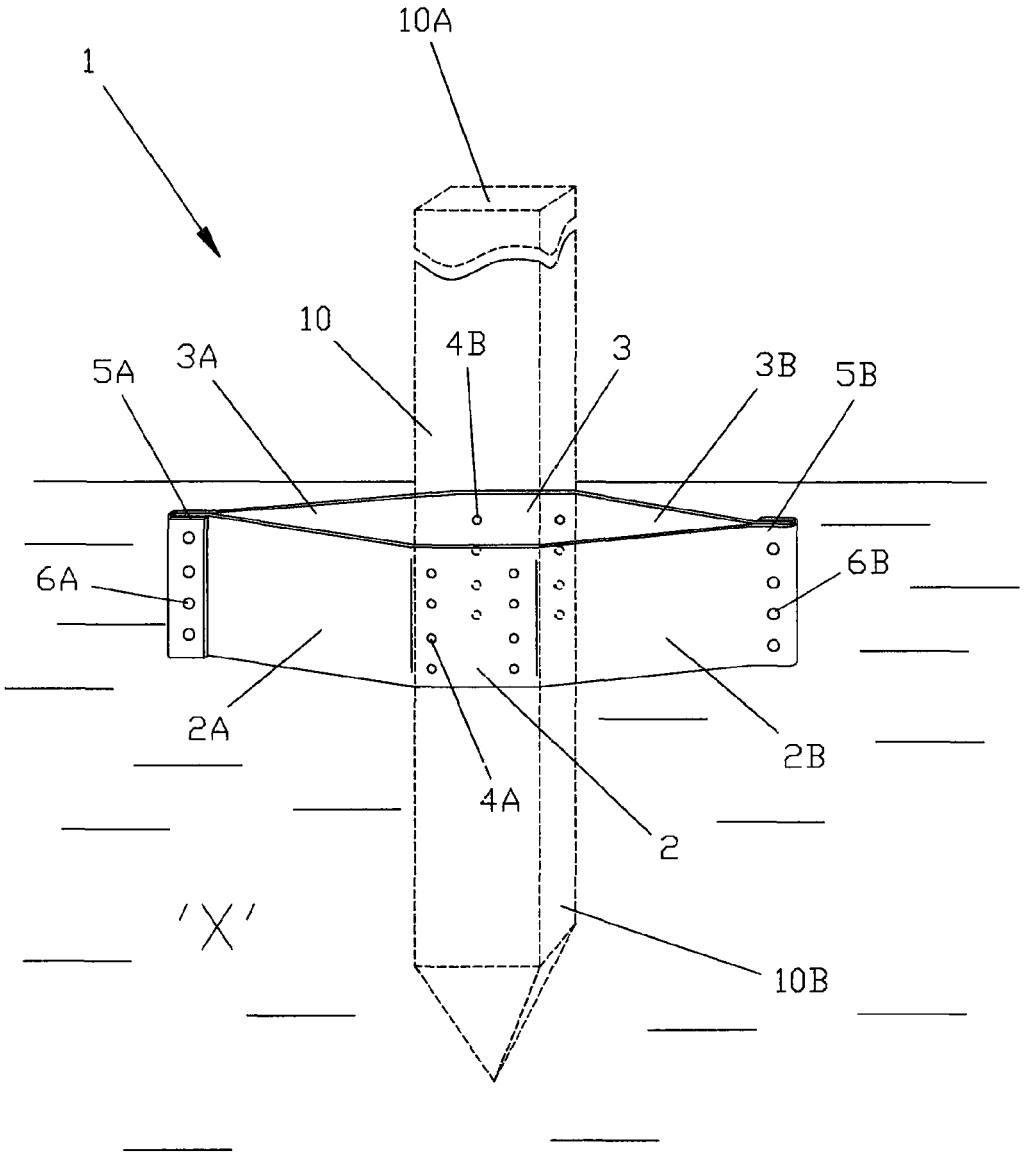
FIG. 1 shows a front view of a post in the form of a post in the ground supported by a support device.
Figure 2:
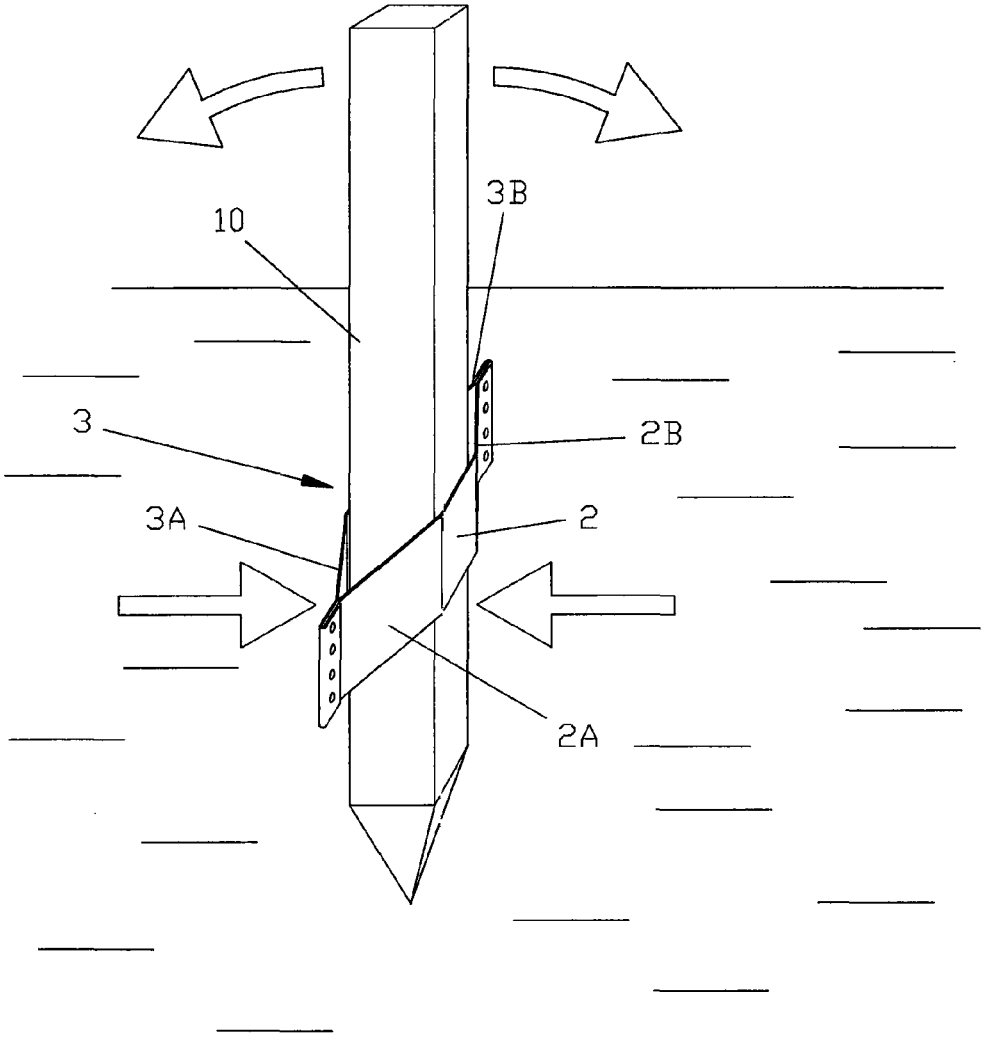
FIG. 2 shows a side view of a post in the ground supported by the support device of FIG. 1.

Referring to FIGS. 1 and 2, a post support device 1 is provided to support a square section fence post 10 adapted to be inserted substantially vertically in the ground. Post 10 has a top end 10A and a bottom end 10B.

Support device 1 has a support member in the form of a pair of opposing plates 2, 3 with securement means in the form of sets of eight holes 4A, 4B to secure them on either side of the post 10 using nails or screws. Plates 2, 3 engage the post below ground level at a point remote from the post bottom end 10B.

Two fins 2A,2B extend from edges of plate 2 and two fins 3A,3B extend from edges of plate 3. Pairs of fins 2A,3A and 2B,3B form a triangulated structure with the plates 2,3 and post 10, with the fins 2A,3A and 2B,3B having opposing faces.

Ends of the pairs of fins 2A, 3A and ends of the pairs of fins 2B, 3B are joined together by a fold 5A in the end of fin 3A engaging with the end of fin 2A and rivets 6A holding the two together, and a fold 5B in the end of fin 2B engaging with the end of fin 3B and rivets 6B holding the two together.

As shown in FIG. 2, with the post inserted substantially vertically in the ground, pairs of fins 2A, 3A and 2B, 3B provide lateral resistance against the material in the ground to prevent the post from displacing the soil and tilting towards the horizontal. A restraining moment is provided with the upper force from the fins and the lower force from the projection of the post. Because the pairs of fins 2A, 3A and 2B, 3B form a triangulated structure with the plates 2, 3, when lateral force is applied (as shown by straight arrows), one fin is always in compression and the other in tension which is a strong structure. This means that the fins can be made of relatively thin material, e.g. from sheet metal. Also the material on either side of and between the pairs of opposing fins 2A, 3A and 2B, 3B provides restraint to the fin under compression to help prevent it from buckling.

Plate 2 with its fins 2A,2B and plate 3 with its fins 3A,3B are integrally formed and are identical components. Prior to connection to a post, these two components nest one within the other for storage, transport and packaging purposes.

Figure 3:
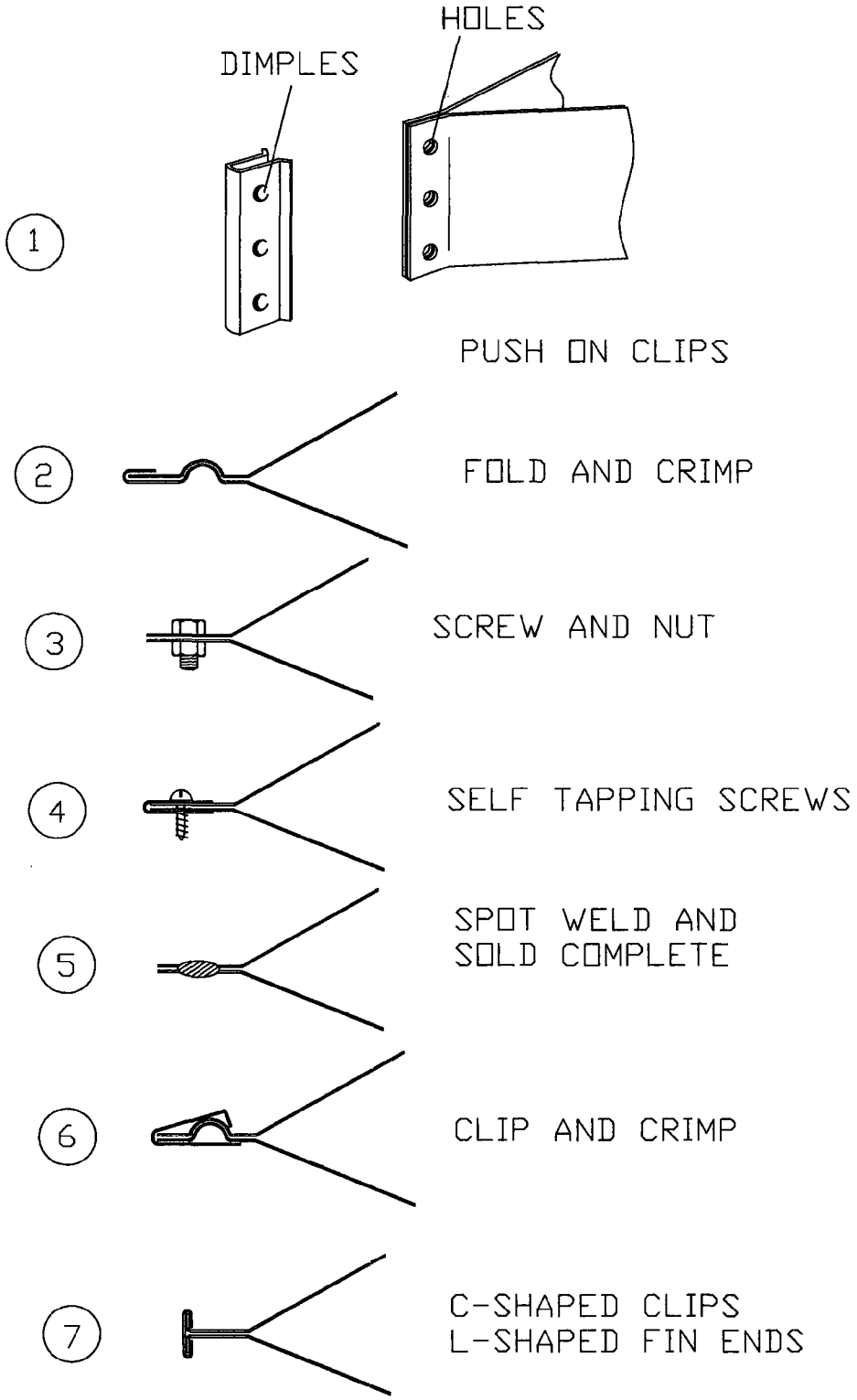
FIG. 3 shows different ways fins may be joined.

Instead of the ends of fins 2A,2B and fins 2B,3B being secured by folds and rivets as shown in FIGS. 1 and 2, they could be secured by other methods as shown in FIG. 3.

Figure 4A:
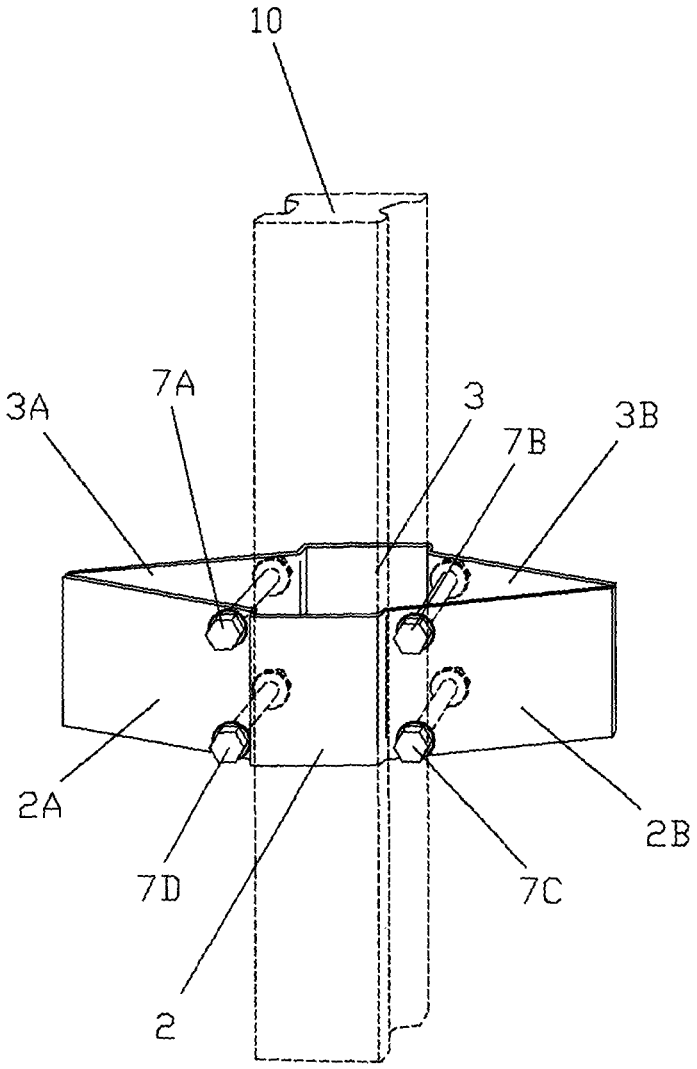
FIG. 4A to 4D shows different support devices supporting different posts other than that shown in FIG. 1.

As shown in FIG. 4A, the support device shown in FIG. 1 could be modified to engage an H-shaped concrete post 10 by means of bolts 7A,7B,7C,7D clamping opposing plates 2,3 either side of the post 10.

Figure 4B:
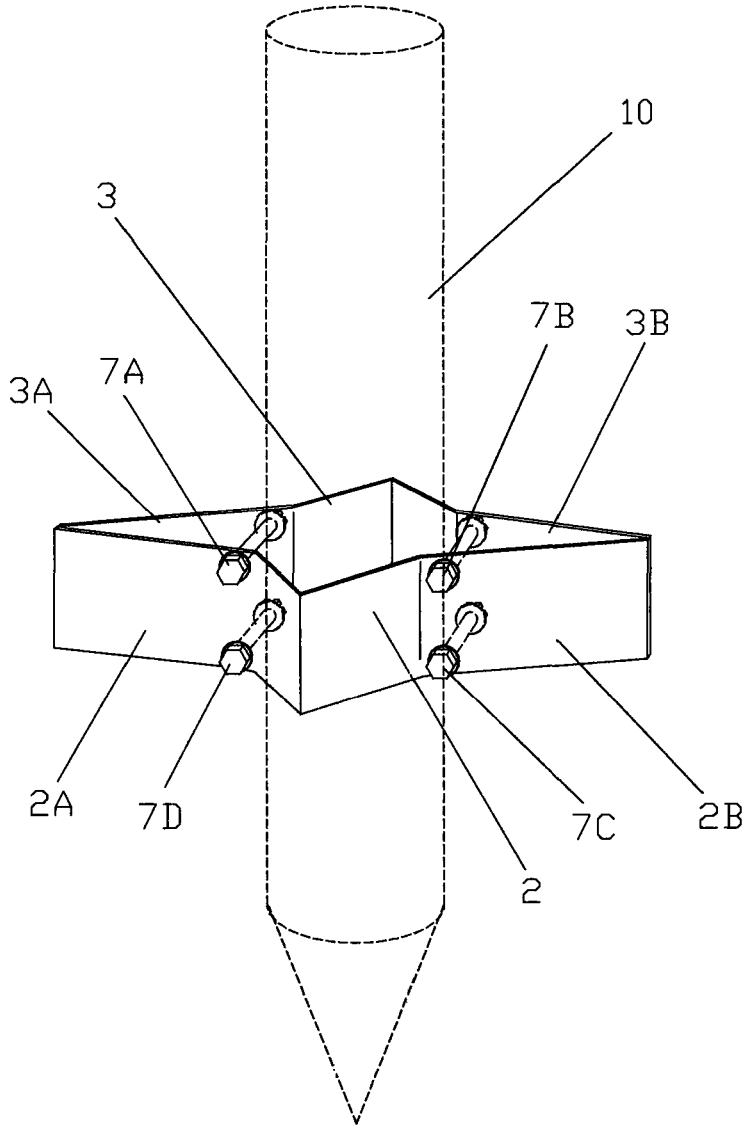

As shown in FIG. 4B, the support device shown in FIG. 1 could be modified to engage a circular section wooden post 10 by means of bolts 7A,7B,7C,7D clamping opposing plates 2,3 either side of the post 10. Also plates 2,3 may be V-shaped instead of planar The support devices described above only provide lateral resistance in one plane against the material in the ground, and so are appropriate for supporting fence posts which only support fence panels or other structures between post in the same plane.

Figure 4C:
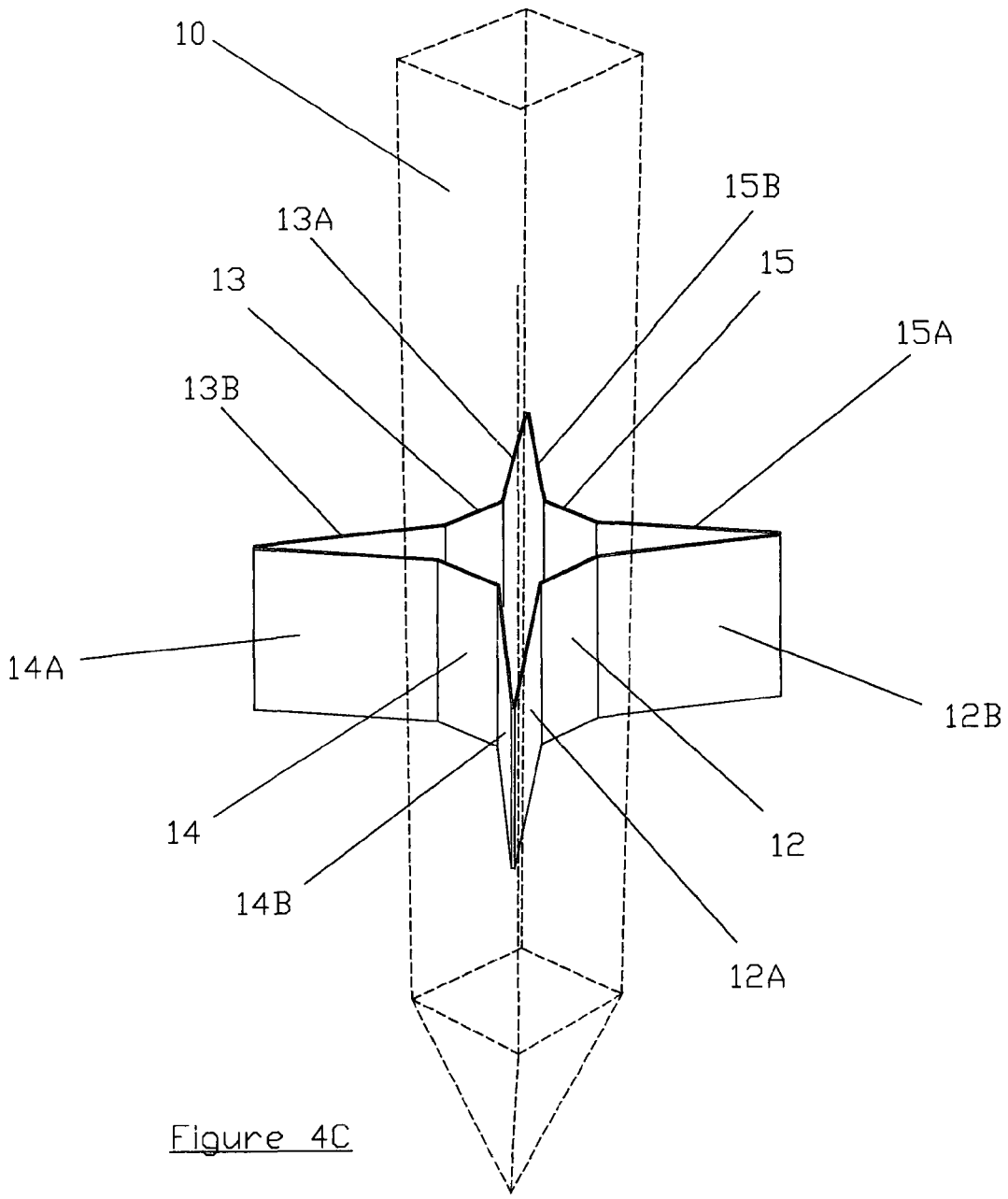
Figure 4D:
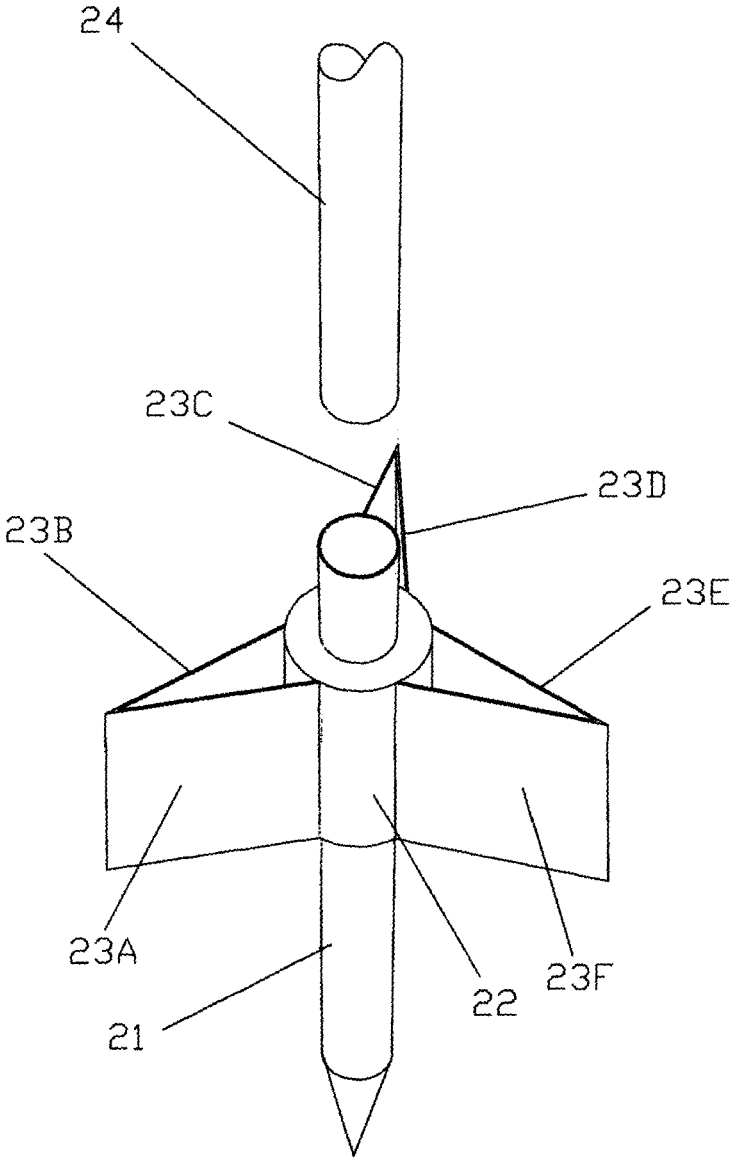

In some instances it may be desirable to have fence posts or other posts supported in two or more planes as shown in FIGS. 4C and 4D.

As shown in FIG. 4C, the support member includes two pairs of opposing plates 12, 13 and 14, 15 to be secured around a post 10. Fins 12A, 12B; 13A, 13B; 14A, 14B; 15A, 15B extend from, and are integrally formed with, opposing edges of each of the plates 12, 13, 14, 15, and the ends of fins from one plate are joined to the ends of fins from another adjacent plate and joined fins form a triangulated structure with two adjacent plates secured to the post 10.

The ends of the fins may be joined by any of the methods described above. Adjacent fins are at 90 degrees to each other and provide lateral resistance in two planes against the material in the ground to prevent the shaft from displacing the soil and tilting towards the horizontal.

As shown in FIG. 4D, the support member includes a hollow cylindrical sleeve 22 adapted to engage the post in the form of a hollow shaft 21 below ground level at a point remote from the shaft bottom end. Three pairs of fins 23A, 23B; 23C, 23D; 23E, 23F each extend radially from, and form a triangulated structure with, the sleeve 22. With the shaft inserted substantially vertically in the ground, the fins provide lateral resistance against the material in the ground to prevent the shaft from displacing the soil and tilting towards the horizontal. Shaft 21 provides a cylindrical recess which may be used to support the pole 24 of a rotary clothes dryer or other washing line post. Alternatively sleeve 22 could receive pole 24 and hollow shaft 21 could be omitted.

Figure 5:
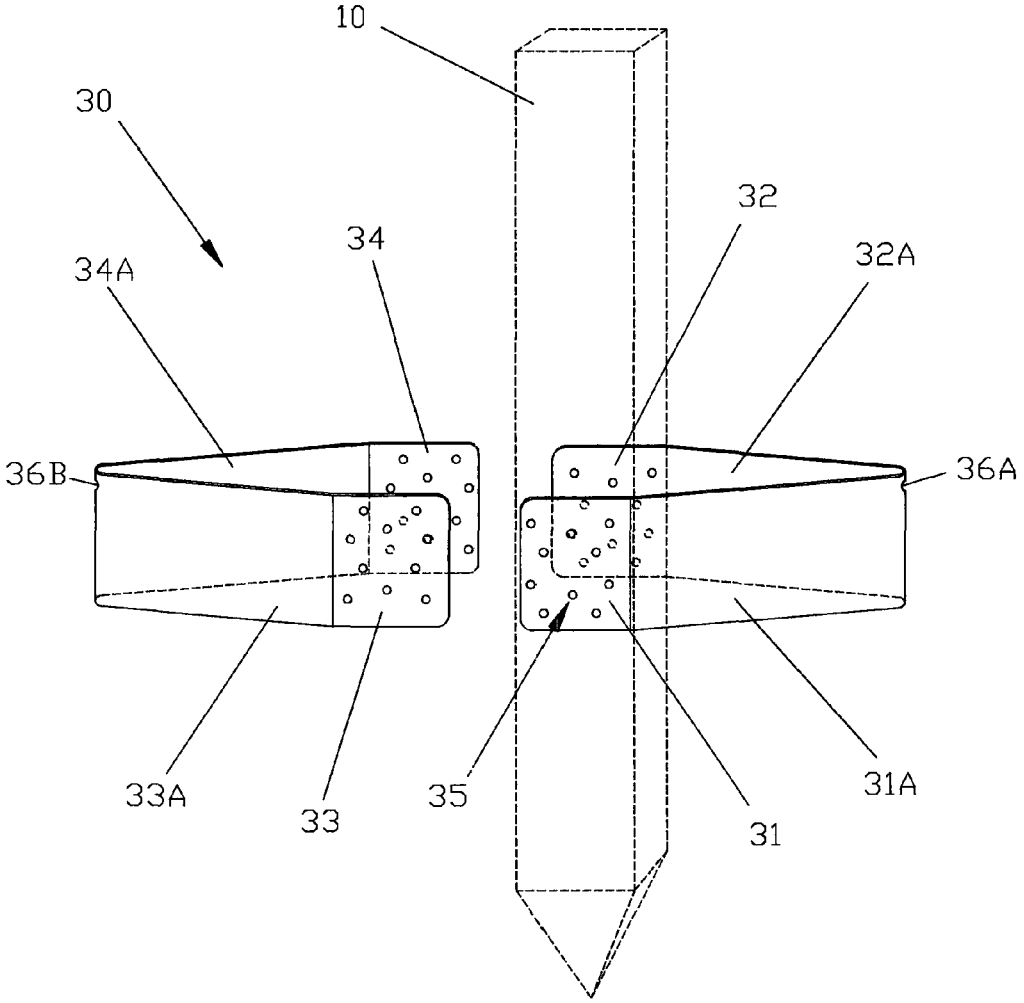
FIG. 5 shows a front exploded view of a post in the form of a post in the ground supported by an alternative support device to that shown in FIGS. 1 and 2.

Referring now to FIG. 5, there is shown a post 10 support device 30. Device 30 has a first support member which includes a first pair of opposing plates 31, 32 to be secured to either side of the post 10, and a first pair of opposing fins 31A, 32A extending from and each integrally formed with one edge of each of the first pair of plates 31, 32. The end of fin 31A from plate 31 is integrally formed with the end of fin 32A from the other plate 32. The support device also includes a second support member which has a pair of opposing plates 33, 34 to be secured to either side of the post 10, and a second pair of fins 33A, 34A extending from and each integrally formed with one edge of each of the second pair of plates 33, 34, and the end of a fin 33A from plate 33 is integrally formed with the end of a fin 34A from the other plate 34. The integrally formed fins from the first or second pair of plates form a triangulated structure with the pairs of plates secured to the post. As shown, first and second pairs of plates 31, 32 and 33, 34 can be secured to either side of the post with the first and second pairs of plates overlapping. Each plate 31, 32, 33, 34 includes a number of apertures 35 to receive nails or screws, with each of the apertures being staggered to prevent a wooden post 10 from splitting when it receives nails or screws (the principal of staggered apertures to prevent splitting could be applied to other embodiments shown in the drawings).

Holes 36A,36B may be provided to secure pairs of support members and fins together, e.g. using a cable tie, so that they can be sold in pairs.

The invention may take a form different to that specifically described above.

Further modifications will be apparent to those skilled in the art.

The invention claimed is:

1. A post support system for a post, the post having a first side, a second side opposing the first side, a third side, and a fourth side opposing the third side, the post support system comprising:

a first support member and a second support member, each of the first and second support members being attachable to the post in an installed state, each of the first and second support members comprising:

a first plate comprising one or more securement apertures adapted for securing the first plate rigidly to the post in the installed state, a second plate opposing and positioned substantially parallel to the first plate, the second plate comprising one or more securement apertures adapted for securing the second plate rigidly to the post in the installed state, a first fin extending from an edge of the first plate, and a second fin extending from an edge of the second plate, wherein the first and second fins of the first support member are configured to meet each other, with the first and second plates of the first support member attached to the post in the installed state, to form a first triangular space with the first side of the post, the first triangular space having an open top and an open bottom to accept a material, wherein the first and second fins of the second support member are configured to meet each other, with the first and second plates of the second support member attached to the post in the installed state, to form a second triangular space with the second side of the post, the second triangular space having an open top and an open bottom to accept the material, wherein the first and second support members are configured to be attached to the third and fourth sides of the post in the installed state, wherein the first plate of the first support member is configured to directly overlap and directly contact the first plate of the second support member in the installed state, and the first plate of the first support member is configured to be positioned substantially parallel to the first plate of the second support member in the installed state, wherein the second plate of the first support member is configured to directly overlap and directly contact the second plate of the second support member in the installed state, and the second plate of the first support member is configured to be positioned substantially parallel to the second plate of the second support member in the installed state, and wherein the first and second fins of the first support member and the first and second fins of the second support member are arranged to provide lateral resistance to prevent the post from tilting towards a horizontal plane with both a portion of the post and the first and second support members attached to the portion of the post being buried in the installed state into ground.

2. A post support system according to claim 1, wherein each of the one or more securement apertures of each of the first and second plates of each of the first and second support members is configured to receive a nail or a screw.

3. A post support system according to claim 1, where the first and second support members are adapted to nest one within the other for storage, transport and packaging purposes.

4. A post support system according to claim 1, wherein the post support system is attachable to a fence cost.

5. A post support system according to claim 1, wherein each of the first and second support members further comprising:

the first plate having an inner surface and an outer surface, the second plate having an inner surface and an outer surface, the first fin having an inner surface and an outer surface, and the second fin having an inner surface and an outer surface, wherein a first reflex angle is defined between the outer surface of the first plate and the outer surface of the first fin, wherein a second reflex angle is defined between the outer surface of the second plate and the outer surface of the second fin, wherein a first obtuse angle is defined between the inner surface of the first plate and the inner surface of the first fin, and wherein a second obtuse angle is defined between the inner surface of the second plate and the inner surface of the second fin.

6. A post support system according to claim 5, wherein the inner surface of the first plate of the first support member is configured to directly overlap and directly contact the outer surface of the first plate of the second support member in the installed state.

7. A post support system for a post, the post having a first side, a second side opposing the first side, a third side, and a fourth side opposing the third side, the post support system comprising:

a first support member and a second support member, each of the first and second support members being attachable to the post in an installed state, each of the first and second support members comprising:

a first plate comprising securement apertures adapted for securing the first plate to the post in the installed state, a second plate opposing and positioned substantially parallel to the first plate, the second plate comprising one or more securement apertures adapted for securing the second plate to the post in the installed state, a first fin comprising a first end and a second end, the first end of the first fin extending from an edge of the first plate, and a second fin comprising a first end and a second end, the first end of the second fin extending from an edge of the second plate, wherein the second end of the first fin of the first support member and the second end of the second fin of the first support member are configured to meet each other such that the first and second fins of the first support member are configured, with the first and second plates of the first support member attached to the post in the installed state, to form a first triangular space with the first side of the post, the first triangular space having an open top and an open bottom to accept a material, wherein the second end of the first fin of the second support member and the second end of the second fin of the second support member are configured to meet each other such that the first and second fins of the second support member are configured, with the first and second plates of the second support member attached to the post in the installed state, to form a second triangular space with the second side of the post, the second triangular space having an open top and an open bottom to accept the material, wherein the first and second support members are configured to be attached to the third and fourth sides of the post in the installed state, wherein the first plate of the first support member is configured to directly overlap and directly contact the first plate of the second support member in the installed state, and the first plate of the first support member is configured to be positioned substantially parallel to the first plate of the second support member in the installed state, wherein the second plate of the first support member is configured to directly overlap and directly contact the second plate of the second support member in the installed state, and the second plate of the first support member is configured to be positioned substantially parallel to the second plate of the second support member in the installed state, and wherein the first and second fins of the first support member and the first and second fins of the second support member are arranged to provide lateral resistance to prevent the post from tilting towards a horizontal plane with both a portion of the post and the first and second support members being buried in the installed state into ground.

* * * * *